US005842293A

United States Patent [19]

Young

[11] Patent Number: 5,842,293

[45] Date of Patent: Dec. 1, 1998

[54] ADJUSTABLE SHOE FOR IN-LINE SKATE

[75] Inventor: Gang Young, Tucheng, Taiwan

[73] Assignee: Tai-Yuan Tsai, Taipei Hsien, Taiwan

[21] Appl. No.: 886,904

[22] Filed: Jul. 2, 1997

[51] Int. Cl.[6] ..... A43B 3/26; A43B 5/04

[52] U.S. Cl. ..... 36/97; 36/115; 280/11.22; 280/11.26

[58] Field of Search ..... 36/7.5, 7.6, 97, 36/115, 50.1; 280/11.22, 11.23, 11.26, 11.27

[56] References Cited

U.S. PATENT DOCUMENTS

| | | | |
|---|---|---|---|
| 5,634,648 | 6/1997 | Tonel et al. | 36/115 |
| 5,678,833 | 10/1997 | Olson et al. | 36/115 |
| 5,682,687 | 11/1997 | Arai | 36/97 |
| 5,694,707 | 12/1997 | Conte | 36/115 |

*Primary Examiner*—Paul T. Sewell
*Assistant Examiner*—Anthony Stashick
*Attorney, Agent, or Firm*—Welsh & Katz, Ltd.

[57] ABSTRACT

An adjustable shoe for an in-line skate is able to adjust its length to provide s snug fit with a user's foot and able to adjust its width to provide a snug fit with a user's ankle.

1 Claim, 3 Drawing Sheets

ADJUSTABLE SHOE FOR IN-LINE SKATE

FIELD OF THE INVENTION

The present invention generally relates to an adjustable shoe, and more particularly to an adjustable shoe for in-line skate. The adjustable shoe is constructed to have a first adjustable device which is able to adjust a width of the shoe to provide a snug fit with a user's ankle and a second adjustable device which is able to adjust a length of the shoe to provide a snug fit with a user's foot.

BACKGROUND OF THE INVENTION

In-line skating is becoming a popular sports throughout the world. Adults, teens and children alike are fascinated by this new sport, and accordingly are willing to pay for a pair of in-line skates of his/her own.

A conventional structure of an in-line skate is shown in FIG. 5. The in-line skate is provided with a plurality of rollers 901 arranged rotatably and linearly under a seat 90. A shoe having a front portion 91 and a rear portion 92 is securely attached on top of the seat 90, such that a user is able to put his/her foot into the shoe. Because at least one first retainer 911 is mounted onto the front portion 91 and at least one second retainer 921 is mounted onto the rear portion 92, a user is able to tighten the shoe to his/her foot. However, due to the front portion 91 and the rear portion 92 being molded integrally, an adjustment of the shoe size is limited. Users will have to search for the exact size matching their feet to have the best performance while using the skates and young users will need to replace the skate altogether each time their foot grows beyond the size of skate. To solve the above mentioned fault, manufactures may need to utilize more modules to produce a wider variety of shoes sizes to fulfill the needs of the customers, which is cost ineffective.

From the previous description, the in-line skate available in the market is not able to fulfill the needs of users and improvements or alterations thereof are thus required. An in-line skate constructed in accordance with the present invention tends to mitigate and/or obviate the aforementioned problems.

SUMMARY OF THE INVENTION

The main objective of the invention is to provide an adjustable shoe for in-line skate. The shoe has an adjustable length to provide a snug fit with a user's foot and an adjustable width to provide a snug fit with the user's ankle, such that users will not need to spend a lot of time searching for the most suitable size to match his need and young users will not need to replace their skates each time their foot grows beyond the size of the skate.

Another objective of the invention is to provide an adjustable shoe for in-line skate, which enables the manufacturers to utilize fewer modules. Because of the adjustability of the shoe, they do not need as many modules to produce enough sizes to satisfy the customers, which cuts costs dramatically.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
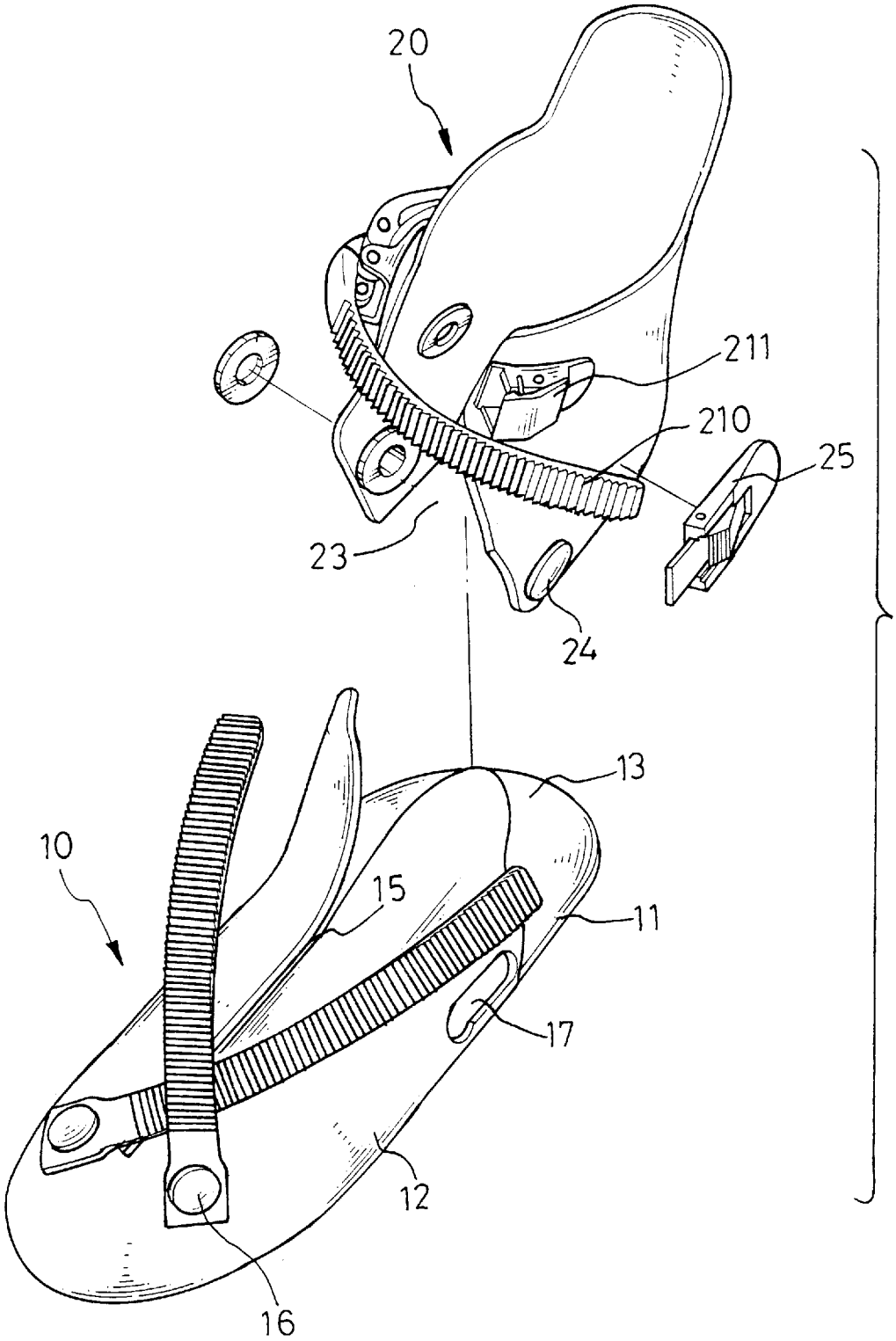
FIG. 1 is a perspective exploded view of an adjustable shoe constructed in accordance with a preferred embodiment of the present invention.

Referring to FIG. 1, one preferred embodiment of an adjustable shoe for an in-line skate and constructed in accordance with the present invention is shown. The shoe comprises a first part 10 and a second part 20 releasably attached to the first part 10. The first part 10 is composed of a base 11, a vamp 12 peripherally connected to a rim of the base 11 and defining rearwardly an open space 13 and a central cut 15. The vamp 12 further defines two opposing elongated cutouts 17 each arranged in a respective half of the vamp 12 which is divided by the central cut 15 and adjacent to the base 11 and has a pair of straps 16 each provided with spikes (not numbered) on a face thereof and crossingly intersected with each other. The pair of straps 16 are securely positioned on the respective half of the vamp 12. The second part 20 is so shaped that when incorporated with the first part 10, the first part 10 and the second part 20 form the shape of a user's heel, that is, the second part 20 defines therein an opening 23 corresponding to the space 13 of the first part 10. Therefore, when the first part 10 is incorporated with the second part 20, the space 13 of the first part 10 mates with the opening 23 of the second part 20. The second part 20 further has a pair of buttons 24 securely arranged therein corresponding to the respective elongated cutouts 17 of the first part 10, a pair of first retainers 25 opposingly positioned with each other, a second retainer 211 securely mounted thereon and a belt 210 pivotally connected thereto to be releasably retained by the second retainer 211 to adjust a width of the second part 20.

Figure 2:
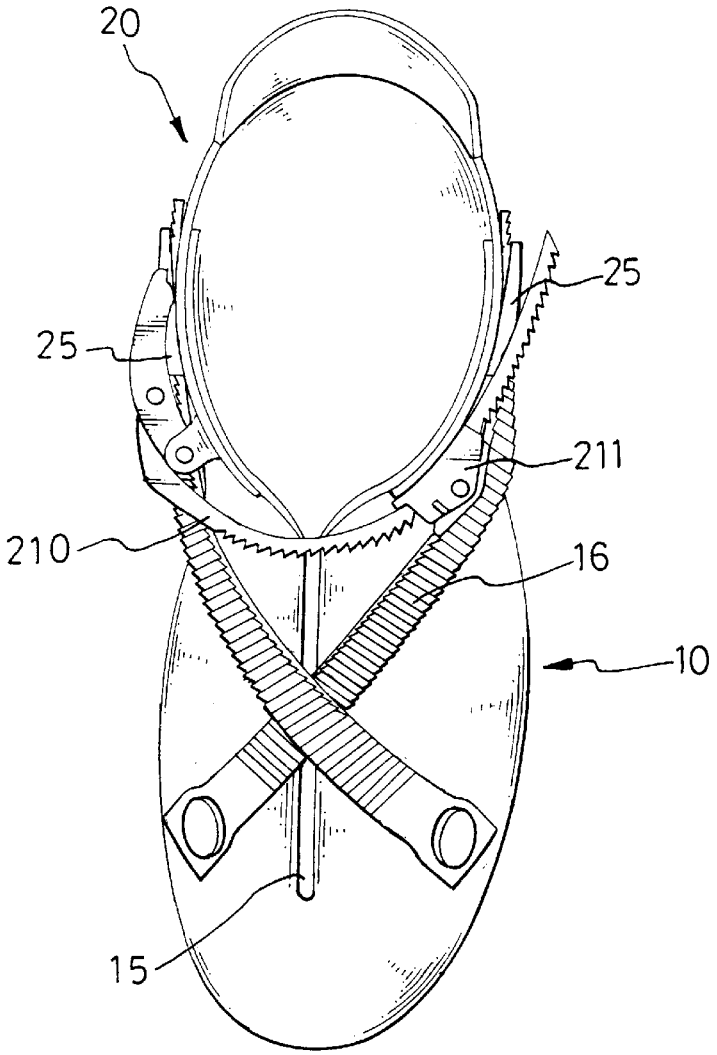
FIG. 2 is a top view of the shoe when in assembly.

Referring to FIG. 2, when the first part 10 and the second part 20 are assembled, firstly, the respective button 24 of the second part 20 is inserted into the corresponding elongated cutout 17 of the first part 10 and then the respective strap 16 is crossingly inserted into the respective first retainer 25 and retained therein. Due to the elongated cutout 17, the button 24 is slidably received within the cutout 17, such that when the respective strap 16 is crossingly retained by the respective first retainer 25, it is able to provide a suitable length for a user's foot. After the straps 16 are retained by the corresponding first retainers 25 to provide a snug fit with a user's foot, the belt 210 is then inserted into the second retainer 211 and secured at a certain position to provide a snug fit with the user's ankle.

Figure 3:
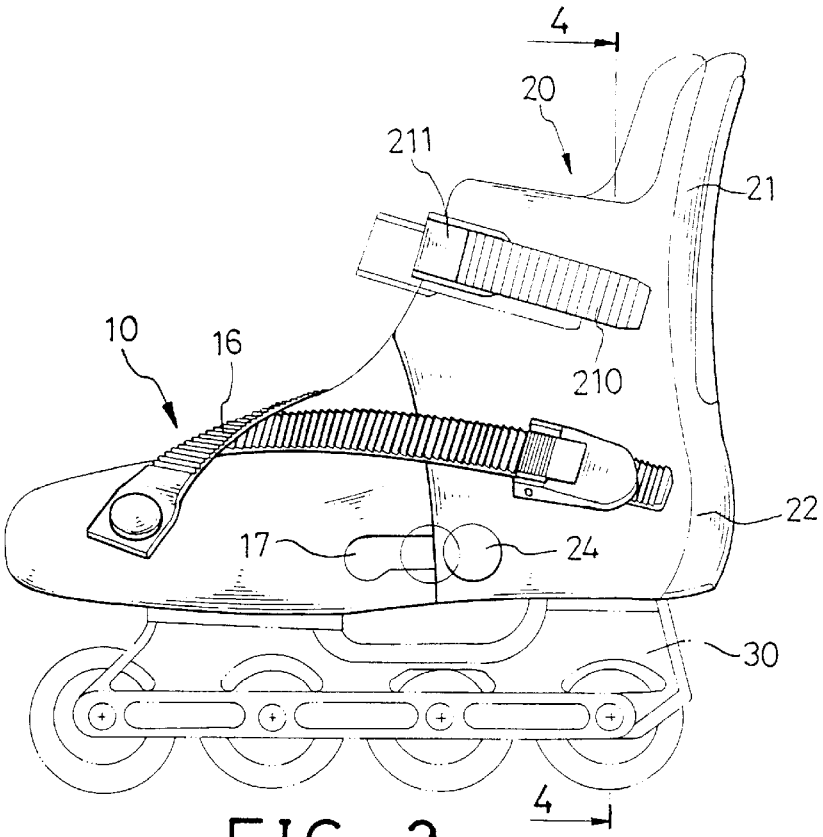
FIG. 3 is a side view of the shoe as shown in FIGS. 1 and 2 showing adjustable patterns thereof.
Figure 5:
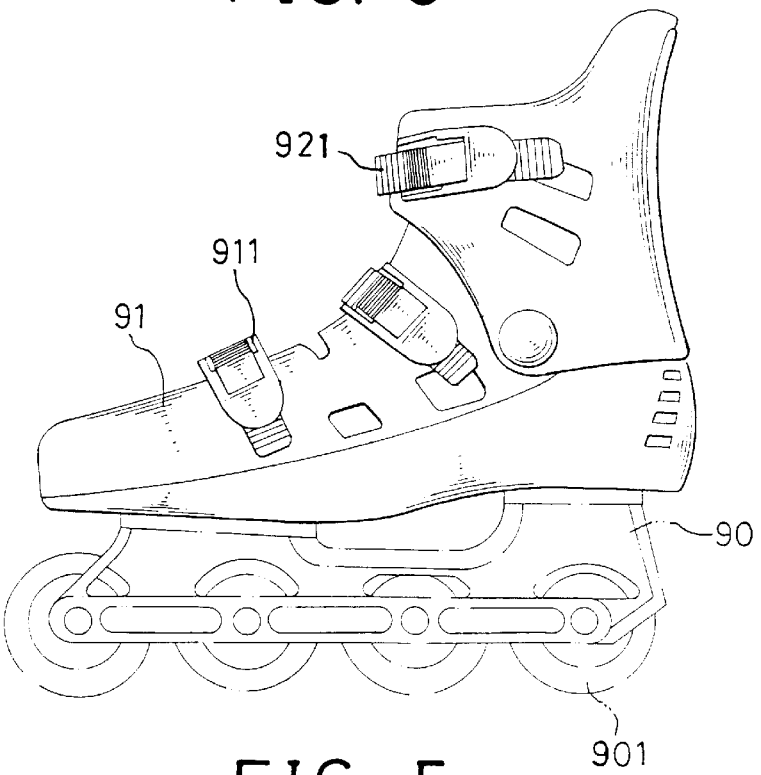
FIG. 5 PRIOR ART
FIG. 5 is a side view of a conventional shoe.

FIG. 3 shows that the buttons 24 of the second part 20 are slidably inserted into the corresponding elongated cutout 17 of the first part 10, which provides adjustability to the shoe of the invention when each of the straps 16 are crossingly inserted into the corresponding first retainer 25 and retained at a certain position to provide a snug fit with the user's foot. Also, the retaining of the belt 210 by the second retainer 211 provides a snug fit with the user's ankle. Therefore, from the description set forth, due to the provision of the pair of elongated cutouts 17, the corresponding buttons 24, the pair of first retainers 16, the corresponding straps 25 and the second retainer 211 with the corresponding belt 210, the shoe of the invention is able to adjust its length and width to provide a perfect match to user's foot size.

Accordingly, customers will no longer need to search for the exact size and manufacturers will save money by reducing the number of different modules.

Figure 4:
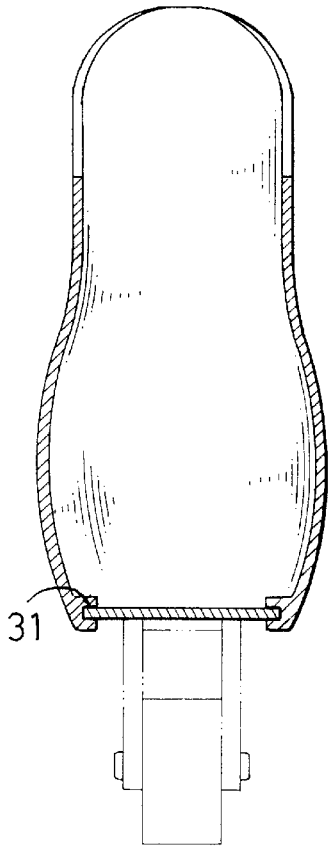
FIG. 4 is a cross sectional view of a heel portion of the invention showing an assembled structure between the first part and the second part.

Additionally, FIG. 4 shows that in order to keep the invention with a rolling device 30 (as shown in FIG. 3) together after the first part 10 and the second part 20 are assembled, a complementary design is provided to an underside of the invention and an upper side of the rolling device 30. A portion of a heel portion of the invention is so configured that an integrally formed track 31 is able to be securely retained by the heel portion of the invention, such that when a user is using the in-line skate for entertainment, the heel portion of the invention is able to be kept in position at all time.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. An adjustable shoe for in-line skate comprising:

a first part having:

a base;

a vamp securely and peripherally attached to a rim of said base and defining therein a central cut to divide said vamp into two halves and a rearward space, two elongated cutouts each opposingly defined within a respective half of said vamp and having two opposingly and crossingly straps each arranged on a respective half of said vamp;

a second part releasably attached to said first part and defining therein an opening corresponding to said space of said first part and having:

a pair of opposing buttons each releasably and slidably received within a corresponding one of each of said elongated cutout;

a pair of first retainers opposingly mounted thereto to respectively receive said strap therein and adjustably retained within a desired position;

a second retainer mounted on a face of said second part; and a belt securely and opposingly arranged to said second retainer and adjustably retained by said second retainer.

* * * * *